United States Patent [19]

Cranston et al.

[11] Patent Number: 4,544,293

[45] Date of Patent: Oct. 1, 1985

[54] PRINTER APPARATUS AND CUTTING MECHANISM

[75] Inventors: Dean H. Cranston; Charles M. Myers, both of Riverton, Wyo.

[73] Assignee: Eaton Corporation, Cleveland, Ohio

[21] Appl. No.: 619,524

[22] Filed: Jun. 11, 1984

[51] Int. Cl.[4] ..... B41J 25/30; B41J 11/70

[52] U.S. Cl. ..... 400/320; 400/322; 400/328; 400/621; 83/602

[58] Field of Search ..... 400/621, 185, 307.2, 400/320, 328, 322; 101/126, 127; 83/597, 602, 605

[56] References Cited

U.S. PATENT DOCUMENTS

| | | | |
|---|---|---|---|
| 1,224,813 | 5/1917 | Trew | 101/227 |
| 3,951,252 | 4/1976 | Selke et al. . | |
| 4,167,345 | 9/1979 | Englund et al. | 400/328 X |
| 4,338,035 | 7/1982 | Kondo et al. | 400/320 X |
| 4,376,585 | 3/1983 | Fromme et al. | 400/185 |

*Primary Examiner*—Edgar S. Burr
*Assistant Examiner*—Charles A. Pearson
*Attorney, Agent, or Firm*—C. H. Grace; M. L. Union

[57] ABSTRACT

A printer apparatus including a printhead (14) for printing on a data carrier (20), a printhead carrier (15) for moving the printhead along a path, a cutter mechanism (30) for cutting the data carrier upon command, a bidirectional drive means (34) having an output shaft (36) operable to be driven in first and second directions and a one-way clutch means (46) operatively associated with the output shaft for actuating the cutter mechanism (30) and driving the printhead carrier (14). The drive means when effecting rotation of the output shaft (36) in the first direction effecting movement of the printhead carrier and printhead along the path and when effecting rotation of the output shaft in the second direction effecting actuation of the cutter mechanism (30) to cut the data carrier.

14 Claims, 2 Drawing Figures

PRINTER APPARATUS AND CUTTING MECHANISM

BACKGROUND OF THE DISCLOSURE

1. Field of the Invention

The present invention relates to a new and improved printer apparatus and more particularly to a printer apparatus which includes a printhead and a cutting mechanism for cutting the data carrier on which the printhead prints, which are both driven by a common drive. The drive is a bi-directional drive and is operable to be driven in a first direction to effect movement of the printhead and driven in a second direction to actuate the cutting mechanism.

Printer mechanisms which include a printhead drive and a cutter mechanism for cutting the data carrier on which the printhead prints are well known in the art. Generally, a first drive mechanism is provided to effect advancement of the printhead relative to the data carrier and a second drive is provided for actuating the cutter mechanism. Such a construction is expensive and occupies substantial space in the printing apparatus.

2. Prior Art

The Englund U.S. Pat. No. 4,167,345 discloses a printing apparatus with selectively moveable printing heads. Englund discloses a separate cut-off means 100 which is actuated by a drive means which also drives the printing head as well as different feeding and shifting devices for the data carrier. The cut-off mechanism is actuated through a mechanical cam and lever mechanism which occupies a substantial amount of space in the printing apparatus and which is expensive to construct. The Selke U.S. Pat. No. 3,951,252 discloses a printing apparatus which includes coupling means for coupling a roller knife carrier to the carrier means for the printhead. In the Selke patent, if it is desired to operate the roller knife, the electromechanical coupling means is actuated and the carrier means together with the roller knife carrier can be moved along a guide as a single unit to effect cutting. The Condo U.S. Pat. No. 4,338,035 discloses a printer with a switch for selectively transmitting the driving force from a driving source to either a carriage or a type wheel.

SUMMARY OF THE INVENTION

The present invention relates to a new and improved printer apparatus which overcomes the problems of the prior art by providing a compact, relatively inexpensive, and accurate mechanism for driving a printhead and a cut-off knife in a printer apparatus. The printhead and cut-off knife are driven by a single drive apparatus which is operable to drive the printhead and actuate the cut-off knife through a one-way clutch mechanism.

The present invention further provides a new and improved printer apparatus including a printhead for printing on a data carrier, a printhead carrier for moving the printhead along a path, a cutter mechanism for cutting the data carrier upon command, a bi-directional drive means having an output shaft operable to be driven in first and second directions and a one-way clutch means operatively associated with the output shaft for actuating the cutter mechanism and driving the printhead carrier. The drive means when effecting rotation of the output shaft in the first direction effecting movement of the printhead carrier and printhead along the path and when effecting rotation of the output shaft in the second direction effecting actuation of the cutter mechanism to cut the data carrier.

DESCRIPTION OF THE PREFERRED EMBODIMENT

Figure 1:
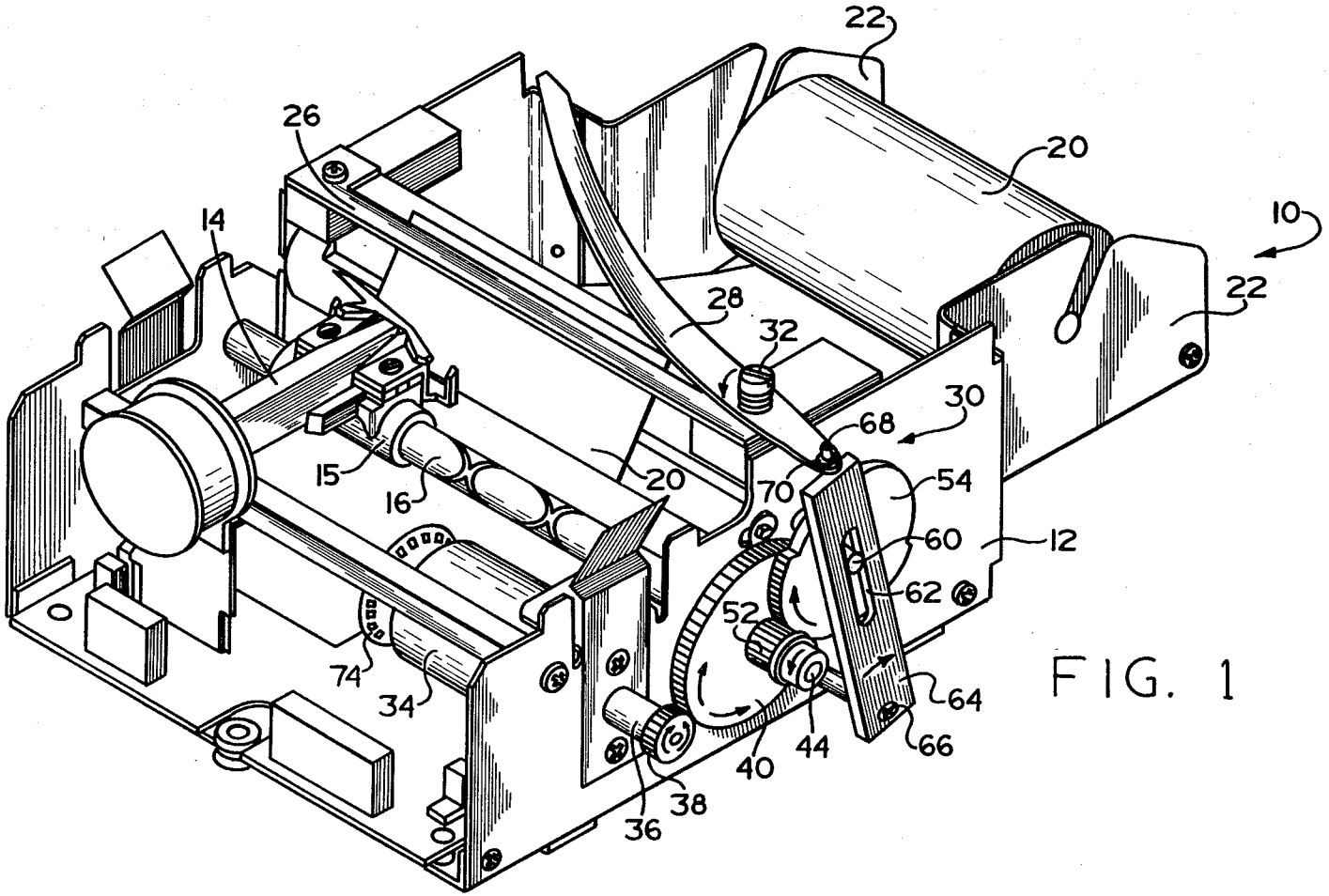
FIG. 1 is a perspective view of the printer apparatus of the present invention.

Referring to the FIGURES, and more particularly FIG. 1, a printer apparatus 10 is disclosed. The printer apparatus 10 includes a frame 12 which supports a printhead assembly 14 which is adapted to print on a data carrier 20 in a well known manner. The printhead assembly 14 is supported for movement on a printhead carrier 15 which in turn is supported on a printhead drive cam 16 for transverse movement relative to the data carrier 20, which in the preferred embodiment comprises a roll of paper. The construction of the printhead assembly 14 and printhead carrier is well known and therefore will not be described in detail. An example, of a well known printhead mechanism is a dot matrix printer such as that disclosed in the Condur U.S. Pat. No. 4,004,671 which is incorporated herein by reference.

Rotation of the printhead drive cam 16 effects transverse movement of the printhead assembly 14 relative to the paper 20 and allows various characters to be printed on the paper 20 in a well known manner. A pair of side frames 22 extend from the frame 12 and support shaft 24 which in turn supports a roll of paper 20. The paper 20 is fed off of the paper feedroll and guided along a predetermined path to the position illustrated in FIG. 1 in which the printhead assembly 14 is adapted to print thereon.

Subsequent to passing adjacent the printhead assembly 14, the paper or data carrier 20 passes adjacent a fixed blade 26 of a cutting mechanism 30 which includes the fixed blade 26 and a moveable blade 28. The fixed blade 26 is secured at both ends thereof to the frame 12 and the moveable blade is adapted to pivot about a pivot pin 32. The pivot pin 32 attaches the fixed blade 26 to the frame 12 and allows the moveable blade 28 to pivot about the pivot pin 32 to effect cutting of the data carrier or paper 20 disposed adjacent the fixed blade 26 as will be more fully described hereinbelow.

A drive motor 34, which preferably is a DC motor, is supported on the frame 12 and is adapted to rotate the printhead drive cam 16 to effect movement of the printhead carrier 15 and printhead assembly 14 and actuates the cutting mechanism 30. To this end, the DC motor includes an output shaft 36 which is adapted to be rotated in a first direction (counterclockwise, as viewed in FIG. 1) to effect rotation of the printhead drive cam 16 and in a second direction, opposite said first direction, (clockwise, as viewed in FIG. 1) to effect actuation of the cutting mechanism 30.

Attached to the motor output shaft 36 for rotation therewith is a first gear or motor pinion 38. The motor pinion 38 meshes with a second gear or cam gear 40 which is supported on a cam shaft 42 by cam shaft extension 44 for rotation therewith. The cam shaft 42 is supported by the frame 12 and supports the printhead drive cam 16 for rotation. Rotation of the motor output shaft 36 and motor pinion 38 will effect rotation of the cam gear 40, cam shaft 42 and printhead drive cam 16 thereby effecting movement of the printhead carrier 15 and the printhead assembly 14 in a well known manner relative to the data carrier 20.

A cam shaft extension 44 is attached to the cam shaft 42 and supports cam gear 40 for rotation therewith. The cam shaft extension 44 rotates in response to rotation of the motor pinion 38. The cam shaft extension 44 provides the driving input to a one-way clutch 46 when cam gear 40 is driven by the motor pinion 38. The one-way clutch 46 includes an output member 48 and a plurality of cam members 50 disposed between the cam shaft extension or input 44 and the output 48. The cams or rollers 50 are operable in a well known manner to drive the output member 48 of the one-way clutch 46 when the cam shaft extension rotates in a counterclockwise direction as viewed in FIG. 1. Rotation of the cam shaft extension 44 in a clockwise direction will be ineffective to effect rotation of the output member 48 of the one-way clutch 46.

A knife pinion 52 is integrally formed with the output member 48 of the one-way clutch 46 and rotates with the output member 48. A third gear, which is a knife sector gear 54, is mounted on a shaft 56 supported on the frame 12 of the printing apparatus 10. The knife pinion 52 is operable to mesh and engage with the knife sector gear 54 and effect rotation thereof upon rotation of the knife pinion 52. The knife sector gear 54 includes a plurality of external teeth thereon which do not extend about the entire periphery of the gear 54. Thus, after a predetermined amount of rotation of the knife pinion 52 the teeth on the knife pinion 52 will disengage with the teeth on the knife sector gear 54 to prevent further rotation of the knife sector gear 54 upon further rotation of the knife pinion gear 52.

The knife sector gear 54 includes a stud 60 which projects therefrom and which is operable to revolve with the knife sector gear 54. The stud or projecting pin 60 on the knife sector gear 54 projects into a slot 62 disposed in a pivot arm 64. The pivot arm 64 is secured to the frame 12 by a shaft 66 which allows the pivot arm 64 to pivot about the longitudinal axis of shaft 66. Rotation of sector gear 54 will cause the stud 60 to revolve and ride in the slot 62 in the pivot arm 64. Revolution of the stud 60 will impart a pivotable movement to the arm 64 as the sector gear 54 rotates.

A pin-shaped extension 68 is disposed on one end of the pivot arm 64 and protrudes into an opening 70 disposed at one end of the moveable cutting blade 28. The opening 70 in the moveable blade 28 is analogous to a finger hole in a common scissors. Thus, rotation of the sector gear 54 and stud 60 will impart a pivoting motion to the arm 64 which causes the moveable knife blade 28 to pivot about the pivot point 32 thereby closing the moveable cutting blade 28 relative to the fixed cutting blade 26.

It should be appreciated that the maximum displacement that the stud 60 on the knife sector gear 54 can provide to the arm 64 is controlled by the configuration of the discontinuous teeth on the sector gear 54. The sector gear 54 can provide through the arm 64 only enough movement of the cutting blade 28 to insure that the moveable cutting blade 28 can sever the full width of the data carrier 20 to be cut with minimum over travel. The number of teeth on the sector gear 54 is limited so that in a runaway motor condition, the knife pinion 52 and sector gear 54 decouple at the end of an otherwise normal full cut.

In a normal printing operation, the motor 34 effects rotation of the motor pinion 38 in a counterclockwise direction as viewed in FIG. 1 which in turn rotates cam gear 40 and cam shaft 42 in a clockwise direction to thereby effect rotation of the printhead drive cam 16 and movement of the printhead assembly 14 and printhead carrier 15 in a well known manner. When it is desired to sever the data carrier 20, the printer motor 34 is brought to a stop. After the motor 34 is stopped, its direction is reversed to thereby rotate the motor pinion 38 in a clockwise direction as viewed in FIG. 1. Rotation of the motor pinion 38 in a clockwise direction effects counterclockwise rotation of the cam gear 40 and the cam shaft extension 44. Counterclockwise rotation of the cam shaft extension 44 engages the one-way clutch 46 and effects counterclockwise rotation of the knife pinion 52 and clockwise rotation of the sector gear 54. Rotation of the sector gear 54 effects pivoting movement of the arm 64 and moveable blade 28 to effect severing of the data carrier 20. After the data carrier 20 is cut, dynamic braking is applied to the DC motor 34 to limit pivoting movement of the knife blade 28 which is also limited by the configuration of the sector gear 54. When the travel of the moveable blade 28 is stopped, the normal counterclockwise direction of rotation of the motor 34 is restored and the motor is driven without printing until the cutting blade 28 is returned to its rest position.

Figure 2:
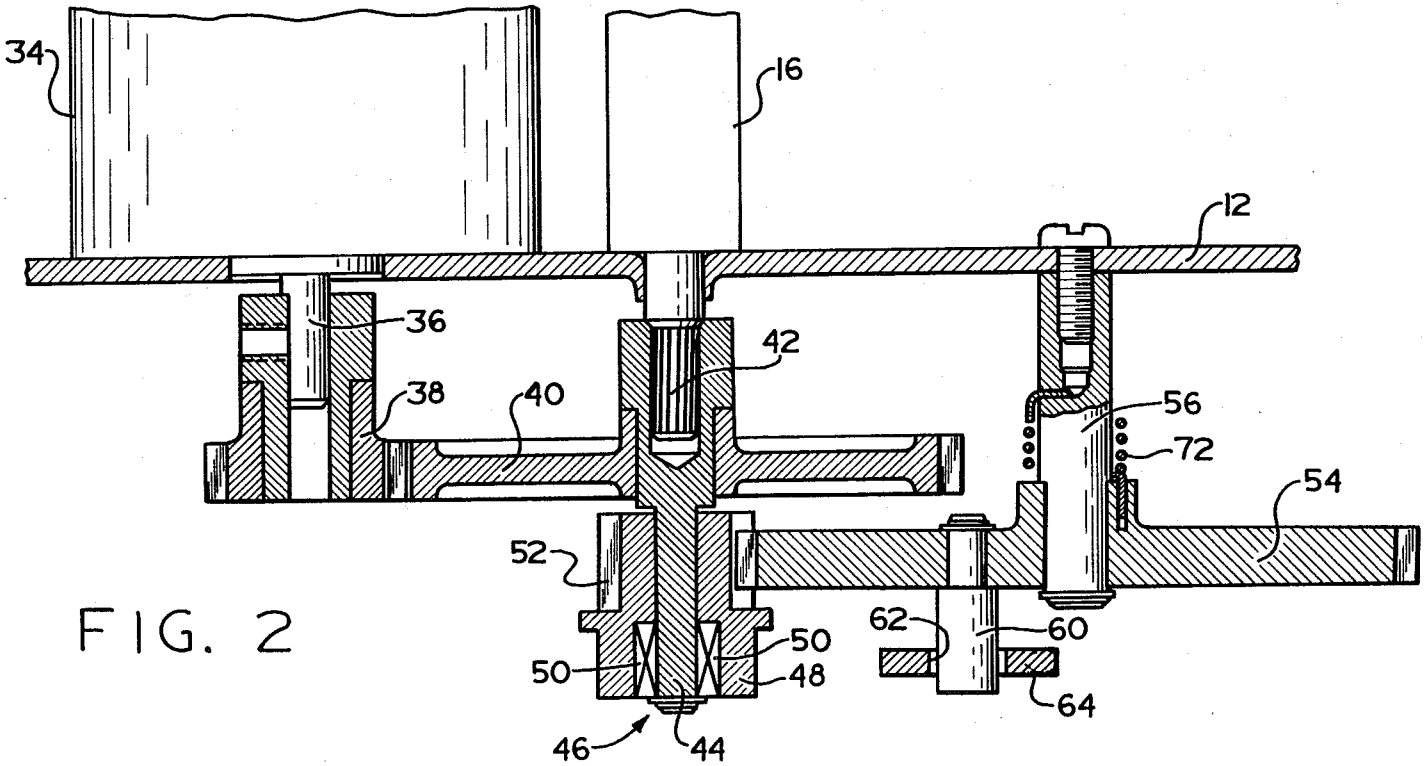
FIG. 2 is a cross-sectional view taken approximately along the lines 2—2 of FIG. 1 more fully illustrating the drive means for driving the cut-off mechanism and printhead carrier.

The knife mechanism cannot be motor driven to its rest position because of the one-way clutch 46. Accordingly, a torsion spring 72 is attached to the sector gear 54 and fixed shaft 56 which support the sector gear 54, as is illustrated in FIG. 2, to provide a return biasing force. The sector gear 54 under the influence of the torsion spring 72 follows the knife pinion 52 when motor 34 rotates in a counterclockwise direction, but is not driven by it. After sufficient motor rotation to insure that the moveable knife blade 28 has returned to its rest position, normal printing can be resumed.

The motor 34 can be provided with a control means to control the speed and direction of rotation of the motor 34. A timing disk 74 is connected to the output shaft 36 of the motor 34 in a well known manner to rotate therewith. The timing disk 74 may include a plurality of apertures, or the equivalent, therein which can be monitored as they pass a reference point. Thus, the speed and/or position of the motor 34 may be monitored by monitoring the timing interval between apertures on the timing disk 74 and/or by monitoring the number of apertures which pass the reference point. The control, not illustrated, is then operable to sense both the speed and the position of the motor 34 in a well known manner by sensing the passage of apertures on the timing disk 74.

The control is also operable to control the actuation of the cutter mechanism 30. The cutter mechanism 30 can be controlled to fully sever the data carrier 20 or to partially sever the data carrier 20 depending on the desires of the operator. The control is operable to monitor the number of pulses or aperatures passing the reference point produced by the timing disk 74 during a cutting operation. After a specified number of pulses is counted, dynamic braking is applied to the motor 34 thereby limiting knife travel to a predetermined length of cut. The number of apertures to be counted or pulses to be produced by the timing disk 74 can be set as a reference in the control to thereby allow the cutting mechanism 30 to fully sever or partially sever the data carrier depending on the desired number of pulses to be counted by the control. It should be appreciated that the travel of the moveable cutting blade 28 is proportional to the movement of the timing disk 74 and the movement of the gears 38 and 40 which are also directly connected to the motor 34. Thus, by counting the number of pulses from the timing disk 74 and limiting the number of pulses to a predetermined number, the operation of the cutting mechanism can be controlled to either fully or partially sever the data carrier 20. While the movement of the cutting blade 28 has been described as proportional to the movement of the timing disk 74, it should be apparent from the drawings that the movement of the cutting blade 28 is not necessarily directly proportional to the movement of the timing disk 74 but will be related to the configuration of the disk 74, gears 38 and 40, the construction of sector gear 54 and the projecting stud 60 disposed thereon. Hence, the movement of the blade 28 will be proportional but may be other than directly proportional to the movement of disk 74 and gears 38 and 40.

From the foregoing it should be apparent that a new and improved printer apparatus 10 has been provided which includes a printhead 14 and printhead carrier 15 for movement along a predetermined path to effect printing on a data carrier 20. A cutter mechanism 30 for cutting the data carrier upon command is provided and a bi-directional drive means in the form of the DC motor 34 is also provided. The bi-directional drive means includes an output shaft 36 which is operable to be driven in first and second directions and a one-way clutch 46 is associated with the output shaft for actuating the cutter mechanism 30 and driving the printhead assembly 14. The DC motor 34 when effecting rotation of the output shaft 36 in the first direction, effects movement of the printhead carrier and printhead along the path and when effecting rotation of the output shaft in the second direction effects actuation of the cutter mechanism 30 to cut the data carrier.

What we claim is:

1. A printer apparatus comprising a printhead for printing on a data carrier, a printhead carrier for moving said printhead along a path, a cutter mechanism for cutting the data carrier upon command, a bi-directional drive means having an output shaft operable to be driven in a first direction and in a second direction, opposite said first direction, a one-way clutch means operatively associated with said output shaft for actuating said cutter mechanism and driving said printhead carrier, said drive means when effecting rotation of said output shaft in said first direction effecting movement of said printhead carrier and printhead along said path and when effecting rotation of said output shaft in said second direction effecting actuation of said cutter mechanism to cut said data carrier, said one-way clutch means being ineffective to actuate said cutter mechanism when said drive means rotates said output shaft in said first direction, control means for controlling the degree of rotation of said shaft upon movement of said shaft in said second direction by said drive means, and means for establishing a reference signal indicative of a desired predetermined degree of rotation of said shaft which is indicative of a desired actuation of said cutter mechanism and wherein said control means is operable to sense the movement of said drive means, compare said sensed movement of said drive means with said reference indicative of a desired predetermined degree of rotation of said shaft to control said drive means to limit the rotation of said shaft in said second direction to a predetermined degree of rotation indicated by said reference signal which actuates said cutter mechanism to cut only a portion of said data carrier and wherein said portion of said data carrier cut is proportional to the predetermined degree of rotation of said shaft.

2. A printer apparatus as defined in claim 1 wherein said bi-directional drive means includes a DC motor having said output shaft, first gear means associated with said output shaft for movement therewith and further including a second gear means operatively associated with said first gear means, said one-way clutch being operatively associated with said second gear means, said one-way clutch including an output member, said output member being driven in response to rotation of said output shaft in said second direction and being inoperable to be driven in response to rotation of said output shaft in said first direction.

3. A printer apparatus as defined in claim 1 wherein said output shaft is operatively associated with and effects movement of said printhead carrier and said printhead when said DC motor rotates in said first and second directions.

4. A printer apparatus as defined in claim 1 wherein said output member is operatively associated with and effects actuation of said cutting mechanism when said output shaft rotates in said second direction.

5. A printer apparatus as defined in claim 4 wherein said cutter mechanism includes a fixed cutting blade disposed adjacent said data carrier and a moveable cutting blade which is moveable relative to said fixed cutting blade, said moveable and fixed cutting blades cooperating to cut the data carrier upon rotation of said output shaft in said second direction.

6. A printer apparatus as defined in claim 1 wherein said cutter mechanism includes a fixed cutting blade disposed adjacent said data carrier and a moveable cutting blade which is moveable relative to said fixed cutting blade, said moveable and fixed cutting blades cooperating to cut the data carrier upon rotation of said output shaft in said second direction.

7. A printer apparatus as defined in claim 6 wherein said bi-directional drive means includes a motor for driving said output shaft and first and second gear means operatively associated with said output shaft for movement therewith, said one-way clutch being operatively associated with said second gear means, said one-way clutch including an output member, said output member being driven in response to rotation of said output shaft in said second direction and being inoperable to be driven in response to rotation of said output shaft in said first direction.

8. A printer apparatus as defined in claim 7 further including third gear means operatively associated with said output member and being rotatable in response to rotation of said output shaft in said second direction and rotation of said output member and a pivot arm pivotable in response to rotation of said third gear means, said pivot arm being operatively associated with said moveable cutting blade for effecting movement of said moveable cutting blade relative to said fixed cutting blade upon pivoting movement of said pivot arm.

9. A printer apparatus as defined in claim 8 wherein said output member is operable to rotate said third gear means to effect a predetermined pivoting movement of said pivot arm and a predetermined movement of said moveable cutting blade relative to said fixed cutting blade and wherein further movement of said output member is ineffective to effect further rotation of said third gear means, further pivoting of said pivot arm and further movement of said moveable cutting blade.

10. A printer apparatus as defined in claim 1 wherein said control means includes a position feedback circuit responsive to the movement of said output shaft of said drive means for controlling the degree of rotation of said output shaft in said second direction.

11. A printer apparatus as defined in claim 1 wherein said control means includes a velocity feedback circuit responsive to the movement of said output shaft of said drive means for controlling the rotation of said output shaft and the position of said printhead along with path.

12. A printer apparatus comprising a printhead for printing on a data carrier, a printhead carrier for moving said printhead along a path, a cutter mechanism for cutting the data carrier upon command, a bi-directional drive means having an output shaft operable to be driven in a first direction and in a second direction, opposite said first direction, a one-way clutch means operatively associated with said output shaft for actuating said cutter mechanism and driving said printhead carrier, said drive means when effecting rotation of said output shaft in said first direction effecting movement of said printhead carrier and printhead along said path and when effecting rotation of said output shaft in said second direction effecting actuation of said cutter mechanism to cut said data carrier, said cutter mechanism including a fixed cutting blade disposed adjacent said data carrier and a moveable cutting blade which is moveable relative to said fixed cutting blade, said moveable and fixed cutting blades cooperating to cut the data carrier upon rotation of said output shaft in said second direction, said bi-directional drive means includes a motor for driving said output shaft and said first and second gear means operatively associated with said output shaft for movement therewith, said one-way clutch means being operatively associated with said second gear means, said one-way clutch means including an output member, said output member being driven in response to rotation of said output shaft in said second direction and being inoperable to be driven in response to rotation of said output shaft in said first direction, third gear means operatively associated with said output member and being rotatable in response to rotation of said output shaft in said second direction and rotation of said output member and a pivot arm pivotable in response to rotation of said third gear means, said pivot arm being operatively associated with said moveable cutting blade for effecting movement of said moveable cutting blade relative to said fixed cutting blade upon pivoting movement of said pivot arm, said third gear means comprising a sector gear having a projecting stud thereon and said pivot arm includes a slot therein for receiving said projecting stud, rotation of said sector gear effecting revolution of said projecting stud and movement of said stud in said slot to thereby effect pivoting movement of said pivot arm.

13. A printer apparatus as defined in claim 12 further including resilient means for biasing said moveable cutting blade away from said fixed cutting blade.

14. A printer apparatus as defined in claim 13 wherein said resilient means comprises a torsion spring operatively associated with said sector gear for biasing said sector gear and said pivot arm.

* * * * *